US006419114B1

(12) United States Patent
Lenz et al.

(10) Patent No.: US 6,419,114 B1
(45) Date of Patent: Jul. 16, 2002

(54) TISSUE BOX

(75) Inventors: Martina Lenz, Frankfurt am Main; Rached Menif, Neu-Anspach, both of (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/674,056

(22) PCT Filed: Apr. 23, 1999

(86) PCT No.: PCT/IB99/00737

§ 371 (c)(1),
(2), (4) Date: Oct. 25, 2000

(87) PCT Pub. No.: WO99/55599

PCT Pub. Date: Nov. 4, 1999

(30) Foreign Application Priority Data

Apr. 28, 1998 (EP) ..... 98870093

(51) Int. Cl.[7] ..... A47K 10/24
(52) U.S. Cl. ..... 221/47; 221/63; 221/50
(58) Field of Search ..... 221/33, 47, 48, 221/50, 55, 63; 206/233

(56) References Cited

U.S. PATENT DOCUMENTS 2,257,340 A 9/1941 Jacobsen
3,239,097 A * 3/1966 Bates et al.
4,200,200 A * 4/1980 Hein, III et al. ..... 221/48
4,879,442 A * 11/1989 Giovine ..... 206/233
5,415,320 A * 5/1995 North et al. ..... 221/63
5,967,321 A * 10/1999 Sigl ..... 206/233 X
6,202,889 B1 * 3/2001 Veith ..... 221/63 X

FOREIGN PATENT DOCUMENTS

DE 9108036 U1 8/1991
EP 0 644 130 A1 3/1995

* cited by examiner

*Primary Examiner*—David H. Bollinger
(74) *Attorney, Agent, or Firm*—Julia A. Glazer; David K. Mattheis; David M. Weirich

(57) ABSTRACT

The present invention is directed to a box (10) for containing tissues, comprising at least one opening (11) located on at least one side of the box, under which a dispensing insert (14) is positioned so that it covers at least partially said opening of the box, said dispensing insert further comprising a cut-out portion (15) or a dispensing slot with at least two portions (16) that contact the border of the box opening, said box being characterized in that the dispensing insert is made out of material with high resilience, so that after being bent it is capable of coming back to its initial shape on its own, without losing its elastic properties.

6 Claims, 1 Drawing Sheet

TISSUE BOX

FIELD OF THE INVENTION

The present invention relates to a box, for containing tissues, that comprises a dispensing insert.

BACKGROUND OF THE INVENTION

The present invention applies to a box for tissues; such containers typically comprise, for example, a body of the box constructed so that tissues can be picked out one by one through an opening located on one side of the box body, and a dispensing insert that covers the box opening. The insert further comprises a dispensing slit or cut-out portion that holds the pop-up tissues. Such pop-up tissues are typically inter-folded to form the stack of tissues, the insert must help dispensing them one by one in such a way that when one tissue is removed from the box, the following one is partially pulled out, and is held in a substantially up-right position by the dispensing insert, so that it is comfortable for the user to grab and pull it during the next use. This requires appropriate balance between the shape and material that are used for the insert.

Some problems typically occur when removing pop-up tissues from a box, such as chaining, and fall-back, for example. This is typically due to friction of tissues onto the insert, or between them, and/or due to an inappropriate shape for the insert opening. Chaining is defined as the fact that when trying one tissue from the box, several tissues are pulled out all-together. Tissues chaining leads to dispensing more than one tissue at a time, which is clearly not the purpose of the pop-up system, and is clearly undesirable to the consumer. Fall-back of tissues is defined as the fact that when removing a first pop-up tissue from the box, the next one completely stays in the box, which is clearly not the purpose of a pop-up system.

The following references are directed to boxes tissues including dispensing insert: U.S. Pat. No. 5,316,177, Kimberley-Clark Co. (KC), May 31, 1994: discloses a pop-up facial tissue dispenser carton box which comprises a paper dispensing window. The dispensing window is provided with an elongated opening having two or more slits emanating from its two ends so that a means for holding the dispensed tissue is provided. German Utility model, by VPS, G9108036 of Aug. 22, 1991: discloses a carton tissue box having an opening located in one of its sides. A paper insert at least partially covers the box opening and comprises an opening as well. The opening in the dispensing insert is such that it reaches the border line of the box opening in at least two points.

Dispensing boxes for tissues as described in the preceding documents have a number of disadvantages. Firstly, while the paper that is used can be coated with a low friction material, it is still noisy. Furthermore, such an insert made out of coated paper, leads to a substantial percentage of tissue fall-back, especially after several tissues have been removed from the box. This generally occurs because the insert is deformed, bent, or even torn up. Secondly, the shapes that are used combined to the paper material also lead to a substantial percentage of tissues fall-backs and chainings.

It is therefore one main object of the present invention to provide the user with a box for containing and dispensing tissues, particularly cosmetic tissues, that comprises an insert that avoids tissue fall-back and chaining.

SUMMARY OF THE INVENTION

The present invention is directed to a box for containing tissues, comprising at least one opening located on at least one side of the box, under. which a dispensing insert is positioned so that it covers at least partially said opening of the box, said dispensing insert further comprising a cut-out portion or a dispensing slot with at least two portions that contact the border of the box opening, said box being characterized in that the dispensing insert is made out of material with high resilience, so that after being bent over a long period of time, it is capable of coming back to its initial shape on its own, without losing its elastic properties.

BRIEF DESCRIPTION OF THE DRAWINGS

The invention will now be explained in detail with reference to the accompanying drawings, in which.

DETAILED DESCRIPTION OF THE INVENTION

Figure 1:
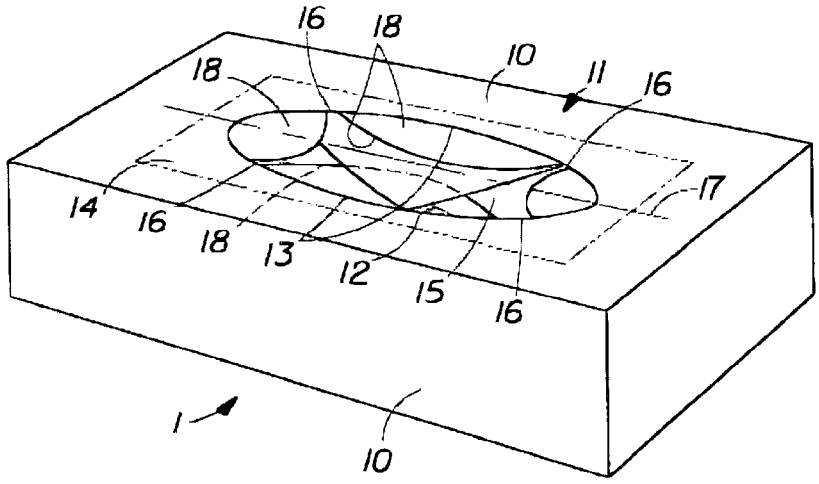
FIG. 1 is a perspective view of the box showing the insert with at least two portions that contact the border of the box opening.

A box (1) is provided, as shown in FIG. 1, which can have any suitable shape, but is preferably a rectangle parallelepiped. It comprises a box body (10) with bottom and top walls facing each other, and front and back walls facing each other, and left and right walls facing each other. The box is made out of any suitable material such as plastic, or flat cardboard for example. The packaging materials are to be used either alone or in combination. Preferably, the box is entirely made out of cardboard material. The box is preferably to contain tissues, more preferably multi-layer tissues. The tissues can be wetted or dry, but are preferably dry tissues.

At least one of the sides of the box body (10), preferably at least the top side, comprises a box opening (11). Optionally but preferably, the box opening is created by the removal of a panel, said panel being created by a precut line (13) in the wall of the box. At first use, this panel is removed and the box opening (11) is created in the box body (10). This box opening (11) comprises a border (12) that corresponds to the precut line (13), once the removable panel has been removed after the first use. Said box opening (11) can have any suitable shape but is preferably ellipsoid. In a preferred embodiment of the present invention, the removable panel comprises a means, for example a notch, that allows the user to insert (14) her/his finger to easily remove the panel before the first use, by tearing it, along the precut line (13), from the rest of the box. Furthermore, as shown in FIG. 1, in the preferred embodiment of the present invention, in which the box (1) has the shape of a rectangle parallelepiped, and the box opening (11) has the shape of an ellipse, the longitudinal axis of said box opening (11) is preferably parallel to the longitudinal axis of the box. However, it can be disposed in another way, for example in diagonal or even perpendicular to said longitudinal axis of the box.

A dispensing insert (14) is attached under said box opening (11), that covers it at least partially. Said dispensing insert (14) is preferably positioned in a plane, but can also be positioned such as to be curved in at least one direction, for example if the side to which it is attached is not plane, but curved. Said dispensing insert (14) is made out of a material with high resilience, such that even after being bent over a long period of time, it does not stay bent and comes back into its initial position, without losing its elastic properties. The material must also be chosen so that after several uses, it does not tear up. This ensures that the insert (14) will keep the same dispensing properties over a long period of time, and will prevent tissue fall-back and chaining. Preferably, the material that is used is a film of a thermoplastic material, such as for example polyethylene or polypropylene, and more preferably polyethylene. This has been tested as a noiseless material with excellent elasticity for comfort of use, and excellent memory properties, thus ensuring stability of the dispensing properties over a long period of time, even with intensive use.

Figure 2:
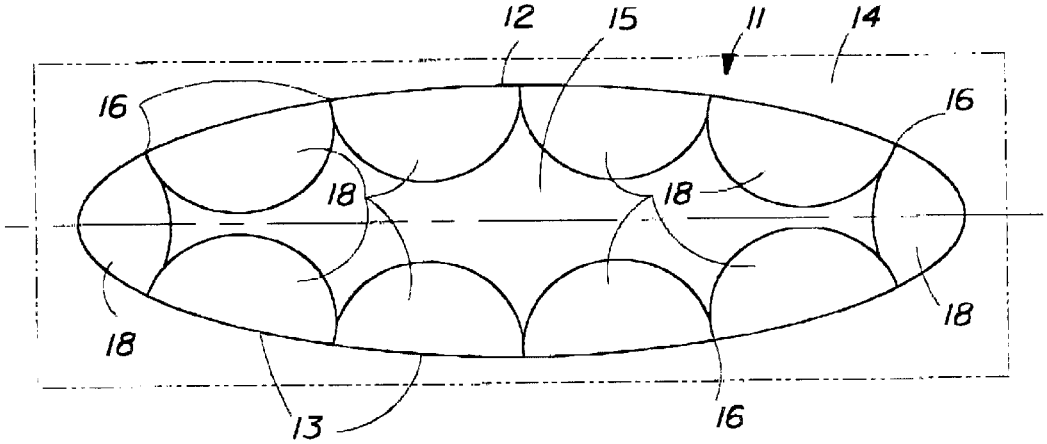
FIG. 2 is a top view showing one embodiment of the invention where the insert opening extends from points to points of the border of the box opening, so as to delimit elastic dispensing tongues.

The dispensing insert (14) further comprises at least one portion that is cut, so that when the insert (14) is fixed onto the box opening (11), tissues can be removed through said cut portion. The cut portion can either be a single dispensing slot, or a larger, cut-out portion (15), as shown in FIGS. 1 and 2. The slot or the cut-out portion (15) can be manufactured by the means of a punch or by using laser cutting for example. It is preferably symmetrical and centered on the insert (14), and parallel to the longitudinal axis of the box opening (11).

In one embodiment of the present invention, at least two points of the dispensing slot or cut-out contact the border (12) of the box opening (11). Preferably, the insert (14) comprises a cut-out portion (15) with four points that contact the border (12) of the box opening (11), as shown in FIG. 1, so that four tongues are created. In the embodiment of the present invention as shown in FIG. 1, the tongues are of unequal length, but are disposed in a symmetrical way so that two long tongues face each other, and two small ones face each other. This particular shape has proved high efficiency in avoiding tissue fall-back and chaining during dispensing.

However, other shapes can be used such as the embodiment shown in FIG. 2. The insert (14) cut-out portion (15) comprises multiple points, preferably more than six points contacting the border (12) of the box opening (11) from one point to another. Such a configuration creates dispensing tongues with reduced length from a contacting point to another, and thus, having high elasticity.

The slot or cut-out portion (15) of the insert (14) is designed such as to allow removal of the tissues one by one from a stack of tissues contained inside the box. In the most preferred embodiment of the invention, the tissues are zigzag-folded so as to provide a so-called pop-up way of dispensing. Such a system is well known by those skilled in the art, and allows removal of articles, usually tissues, one by one from a container, in such a way that when a first tissue is removed from the box, the following one is partially pulled out of the box. The purpose of such a system is that, after removal of a tissue, the following one stands in an up-right position, ready to be dispensed by the user. Furthermore, in one preferred embodiment of the present invention, the leading edge of the first tissue to be removed, is bent along a diagonal, relatively to the longitudinal axis of the insert (14) dispensing slot or cut-out portion (15), the leading edge being defined as the edge of the tissue that the user takes when removing the tissue from the box. This allows the consumer to pick up the first tissue from the box in a more convenient way.

The combination of the shape of insert (14) opening with a material with high elasticity and memory, proved surprisingly efficient in avoiding tissue fall-back and chaining, as well as in keeping the leading edge of a tissue in up-right position, even over a long and intensive period of use.

What is claimed is:

1. A box (1) for containing tissues, comprising a box body (10), further comprising at least one box opening (11) located on at least one side of the box body (10), under which dispensing insert (14) is positioned so that it covers at least partially said box opening (11), said dispensing insert (14) further comprising a cut-out portion (15) or a dispensing slot (15) with at least two portions (16) that contact the border (12) of the box opening (11), said box (1) being characterized in that the dispensing insert (14) is made out of material with high resilience, so that after being bent, it is capable of coming back to its initial shape on its own, without losing its elastic properties;

wherein the leading edge of the first tissue is folded along a diagonal, such as to facilitate the removal of said first tissue from the box.

2. A box (1) according to claim 1, wherein the insert (14) is made out of a thermoplastic material.

3. A box (1) according to claim 2, wherein the insert (14) is made out of a polyethylene film.

4. A box (1) according to claim 1, wherein the box body (10) is entirely made out of a paper material.

5. A box (1) according to claim 4, wherein the box body (10) is entirely made out of flat cardboard.

6. A box (1) according to claim 1, wherein the dispensing cut-out portion or slot (15) of the dispensing insert (14) extends from points (16) to other points (16) of the border (12) of the box opening (11), so as to delimit elastic dispensing tongues (18).

* * * * *